United States Patent [19]

Wang

[11] Patent Number: 4,907,141

[45] Date of Patent: Mar. 6, 1990

[54] MINIATURE FLASHLIGHT

[76] Inventor: Fu H. Wang, No. 7, Alley 14, Lane 64, Ching Ping Rd., Chung Ho City, Taipei Hsien, Taiwan

[21] Appl. No.: 356,709

[22] Filed: May 25, 1989

[51] Int. Cl.[4] ..... F21L 7/00

[52] U.S. Cl. ..... 362/205; 362/203

[58] Field of Search ..... 362/190, 197, 202, 203, 362/205, 208

[56] References Cited

U.S. PATENT DOCUMENTS

| | | | |
|---|---|---|---|
| 4,398,238 | 8/1983 | Nelson | 362/202 X |
| 4,777,582 | 10/1988 | Sharrah | 362/202 X |
| 4,819,141 | 4/1989 | Maglica et al. | 362/197 X |

FOREIGN PATENT DOCUMENTS

| | | | |
|---|---|---|---|
| WO88/01359 | 2/1988 | World Int. Prop. O. | 362/202 |

*Primary Examiner*—Ira S. Lazarus
*Assistant Examiner*—Peggy Neils
*Attorney, Agent, or Firm*—Rogers, Howell & Haferkamp

[57] ABSTRACT

A miniature flashlight including a cylindrical tube enclosed at a rear end by a tail cap, a control ferrule rotatably connected to a front end of the cylindrical tube, and a face cap with a lens and a reflector threadedly engaged at a front end of the control ferrule. One or more batteries are disposed within said tube, and a spring member is located between the tail cap and the adjacent battery. A guide means is disposed within the fron end of the tube. A slidable socket is threadably connected within the control ferrule in order to be pushed along a longitudinal axis of the tube. Two resilient blades are disposed in the slidable socket with one end of the first resilient blade slidably contacting the guide and one end of the second resilient blade contactable with an anode of a foremost battery. A light bulb is plugged into said slidable socket. The sliding movement of the slidable socket brings the end of the second blade into contact with the anode of the foremost battery.

1 Claim, 6 Drawing Sheets

MINIATURE FLASHLIGHT

FIELD OF THE INVENTION

The present invention relates to flashlights, and more particularly relates to miniature flashlights.

BACKGROUND OF THE INVENTION

Flashlights utilizing two or more dry cell batteries as their source of electrical energy are well known in the art. A miniature hand-held flashlight with variable dispersion was developed to improve the functions of flashlights, as shown in prior art FIGS. 5 TO 7.

The prior art flashlight comprises a cylindrical tube 6 containing at least two miniature dry cell batteries disposed in a series arrangement. A lip 69 is formed at the front end of the tube 6. A head 7 is threadably connected to one end of the tube 6. A cap 8 with a parabolic reflector 81 is disposed within the outer end of the head 7. A side conductor 62 and a center conductor 63 are disposed between a first insulator receptacle 61 and a second insulator receptacle 71. The prongs 73 of a light bulb 75 are respectively connected to the side and center conductors 62, 63. The center electrode 67 of the forwardmost battery 66 is urged into contact with the center conductor 63. When the conventional flashlight is in "off" condition, as shown in FIG. 6, the first insulator receptacle 61 is pushed rearward by the second insulator receptacle 71 so that a space is formed between the foremost surface by the first insulator receptacle 61 and the lip 69 on the forward end of the tube 6. Therefore, the side conductor 62 is separated from contact with the lip 69 on the tube 6. Referring next to FIG. 7, appropriate rotation of the head 7 causes the head to move forward a sufficient distance so that the reflector 81 and the insulator receptacles 61, 71 can be pushed forward by the action of the spring 64 until the side conductor 62 comes into contact with the lip 69 of the tube 6. At that point, the side conductor 62 electrically contacts the lip 69 of the tube 6 and turns the flashlight to "on" condition. Further rotation of the head 7 causes a relative motion between the reflector 81 and the light bulb 75 so as to vary the dispersion of the light beam.

There are some problems concerning this prior art:

(a) No stops are provided between the head and the tube 6, therefore, the head and tube are easily separated by further rotation of the head 7.

(b) After rotating the head a sufficient distance, a water sealing ring provided on the tube 6 is exposed, thus the water seal between the head 7 and the tube 6 is ineffective. Furthermore, no sealing ring is provided between the cap 8 and the lens 83.

The present invention has arisen to mitigate and/or obviate the afore-described disadvantages of the flashlight.

SUMMARY OF THE INVENTION

A primary object of the present invention is to provide a miniature flashlight having a watertight or airtight sealing.

Another object of the present invention is to provide a miniature flashlight capable of preventing the separation between the head and the tube.

The present invention seeks to provide a miniature flashlight including a cylindrical tube enclosed at a rear end by a tail cap, a control ferrule rotatably connected to a front end of the cylindrical tube, and a face cap with a lens and a reflector threadedly engaged at a front end of the control ferrule; one or more batteries being disposed within said tube, a spring member being located between the tail cap and an adjacent battery; a guide means being disposed within the front end of the tube; a slidable socket threadably connected within the control ferrule in order to be pushed along a longitudinal axis of th tube; a first and a second resilient blade being disposed in the slidable socket with one end of the first resilient blade slidably contacting the guide and one end of the second resilient blade contactable with an anode of a foremost battery; and a light bulb plugged into said slidable socket; in which said sliding movement of the slidable socket brings the end of the second blade into contact with the anode of the foremost battery.

Further objects and advantages of the present invention will become apparent from a careful reading of the detailed description provided hereinbelow, with appropriate reference to the accompanying drawings.

DETAILED DESCRIPTION OF THE INVENTION

Figure 1:
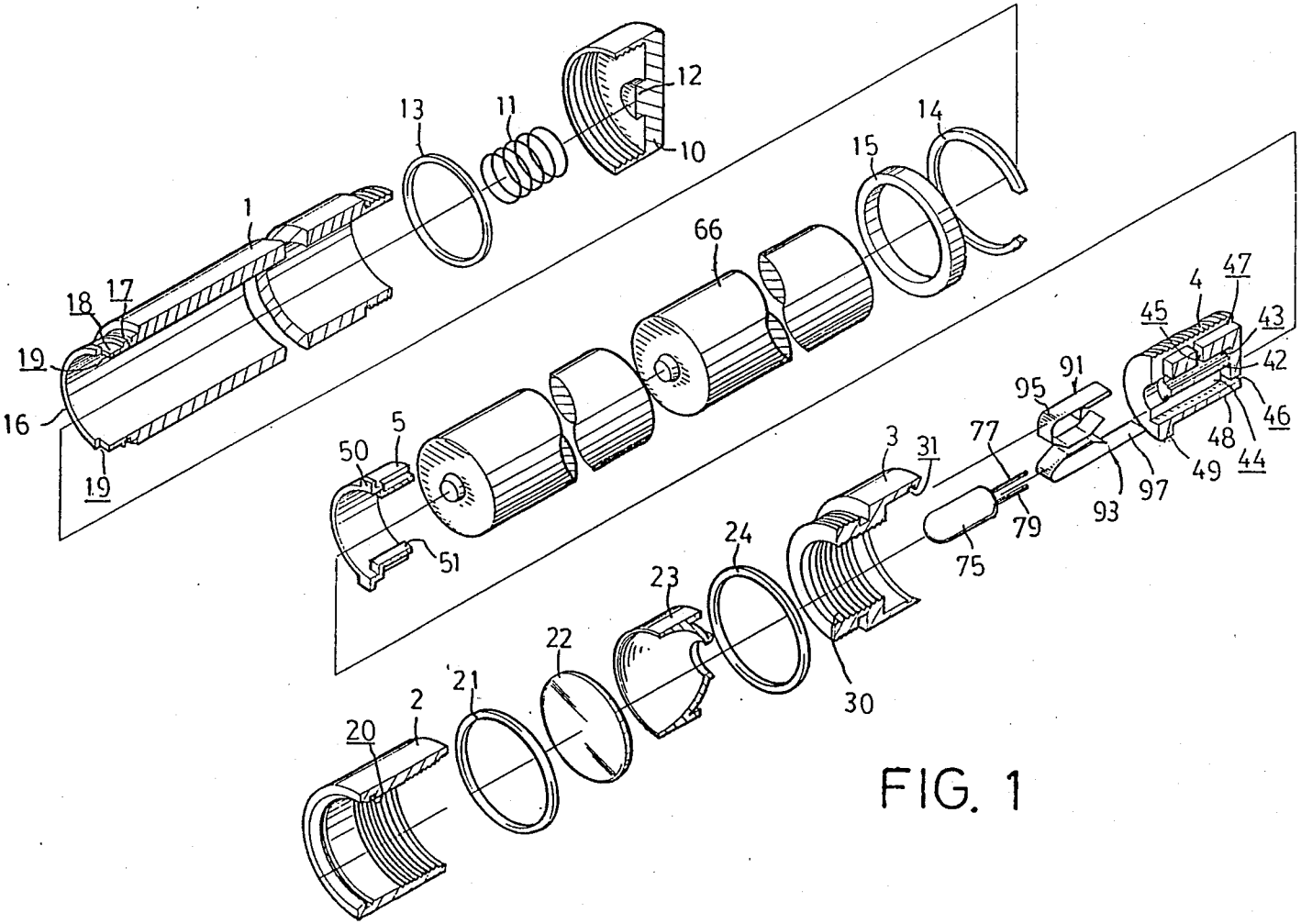
FIG. 1 is an exploded perspective view of a miniature flashlight in accordance with the present invention.
Figure 2:
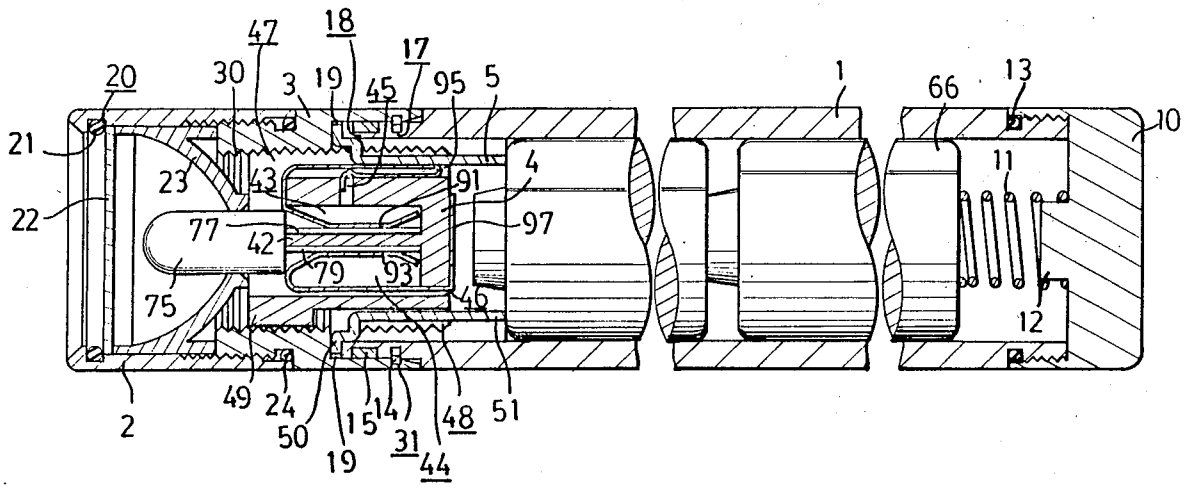
FIG. 2 is a cross-sectional view of the assembled miniature flashlight of FIG. 1.

Referring to FIGS. 1 and 2, a miniature flashlight in accordance with the present invention comprises a cylindrical tube 1 which is threadedly closed and engaged at a rear end by a tail cap 10 a face cap 2, a control ferrule 3, a slidable cylindrical socket 4, a sleeve 5, and batteries 66. Two annular grooves 17, 18 are formed side by side on an outer surface of the other reduced diameter end 16 of tube 1. Two rectangular holes 19 are formed on the opposite sides of the outermost edge of the end 16. One end of a spring 11 encompasses a protrusion 12 formed in the inner surface of the cap 10. One or more batteries 66 are disposed within the tube 1. The other end of the spring 11 bears against a cathode of an adjacent battery 66. A first sealing ring 13 encompasses the rear end of the tube 1, adjacent to the threads, for making an airtight engagement between the tube 1 and the cap 10. A rotatable control ferrule 3 with an annular inner groove 31 is rotatably connected to the tube 1 by a retaining ring 14, which is rotatably disposed within the abutment grooves 17 and 31, which in turn are respectively formed on the outer end 16 of the tube 1 and on the inner side of the control ferrule 3. A second sealing ring 15 is force-fitted within the groove 18. A face cap 2 is threadedly connected to the outer end of the control ferrule 3 with a third sealing ring 21, a lens 22 and a reflector 23 clamped in series therebetween. The third sealing ring 21 is engaged within the groove 20. A fourth sealing ring 24 is further disposed between the face cap 2 and the control ferrule 3 close to one end of the face cap 2. A threaded bore 30 is formed within the control ferrule 3.

The sleeve 5 has two diametrically opposite ears 50 protruding from one end thereof and two diametrically opposite guide lugs 51 extending lengthwise along the inner diameter thereof. The ears 50 of the sleeve are clamped between the control ferrule 3 and the tube 1. The slidable cylindrical socket 4 has a threaded outer surface so as to be connectable to the threaded bore 30 of the control ferrule 3. Two lateral compartments 43, 44 are formed on a substantially vertical plane of the socket 4 and separated by an insulation partition 42. Two lateral guide slots 47, 48 are respectively formed on the outer side of the compartments 43, 44. A stop 49 is formed on the front end of the guide slot 48. A vertical slit 45 connects the guide slot 47 and the compartment 43. A lateral slit 46 is formed on one end of the compartment 44. Two resilient blades 91, 93 each folded into a specific shape are respectively inserted into the compartments 43, 44. An outer part 95 of resilient blade 91 lies within the guide slot 47. One end of resilient blade 91 is folded or bent to engage with the vertical slit 45. One end 97 of resilient blade 93 passes through the lateral slit 46. The end 97 is folded and bears against an outer end surface of the socket 4. Two prongs 77, 79 of a lamp bulb 75 are inserted into the socket 4 and electrically connected to the resilient blades 91, 93 respectively.

Referring again to FIG. 2, it can be seen that when assembled, the cap 2 is fixed relative to the control ferrule 3. The guide lugs 51 of the sleeve 5 lie within the guide slots 47, 48 of the socket 4 so that the socket 4 is slidable along the longitudinal axis of the flashlight by the guidance of the guide lugs 51. The outer part 95 of the resilient blade 91 slidably contacts the guide lugs 51 and makes an electrical connection therebetween. In this figure, the socket 4 is at a foremost position and bears against the reflector 23. The foremost battery 66 is separated from the folded end 97 of the resilient blade 93 by the guide lugs 51. This is the "off" position.

Figure 3:
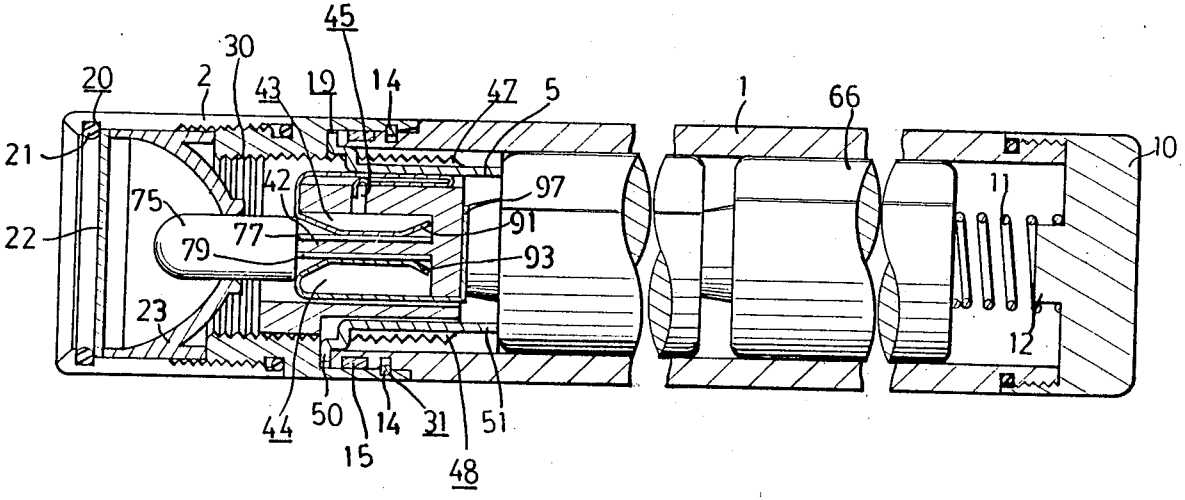
FIG. 3 is a cross-sectional view similar to FIG. 2, illustrating an "on" condition of the miniature flashlight.
Figure 4:
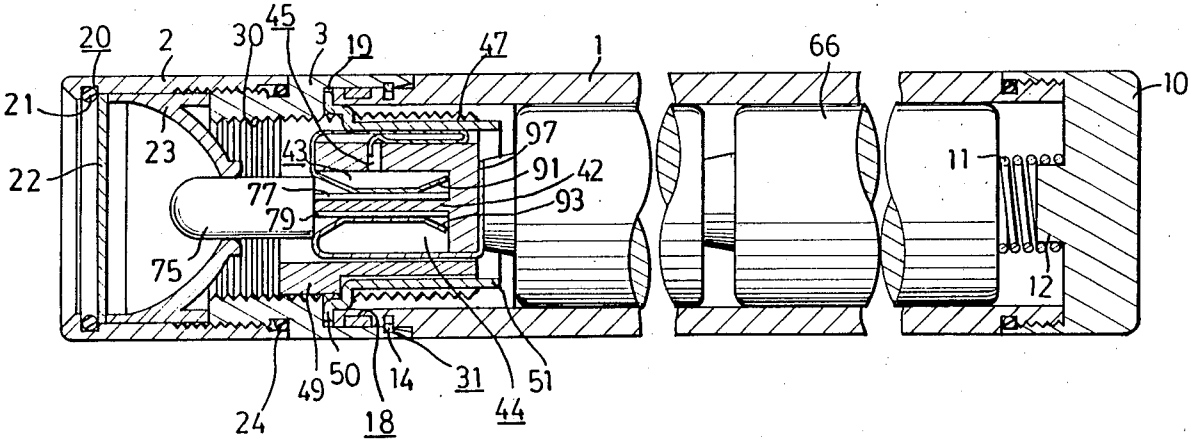
FIG. 4 is a cross-sectional view similar to FIGS. 2 and 3, illustrating the varying of the dispersion of the light beam.
Figure 5:
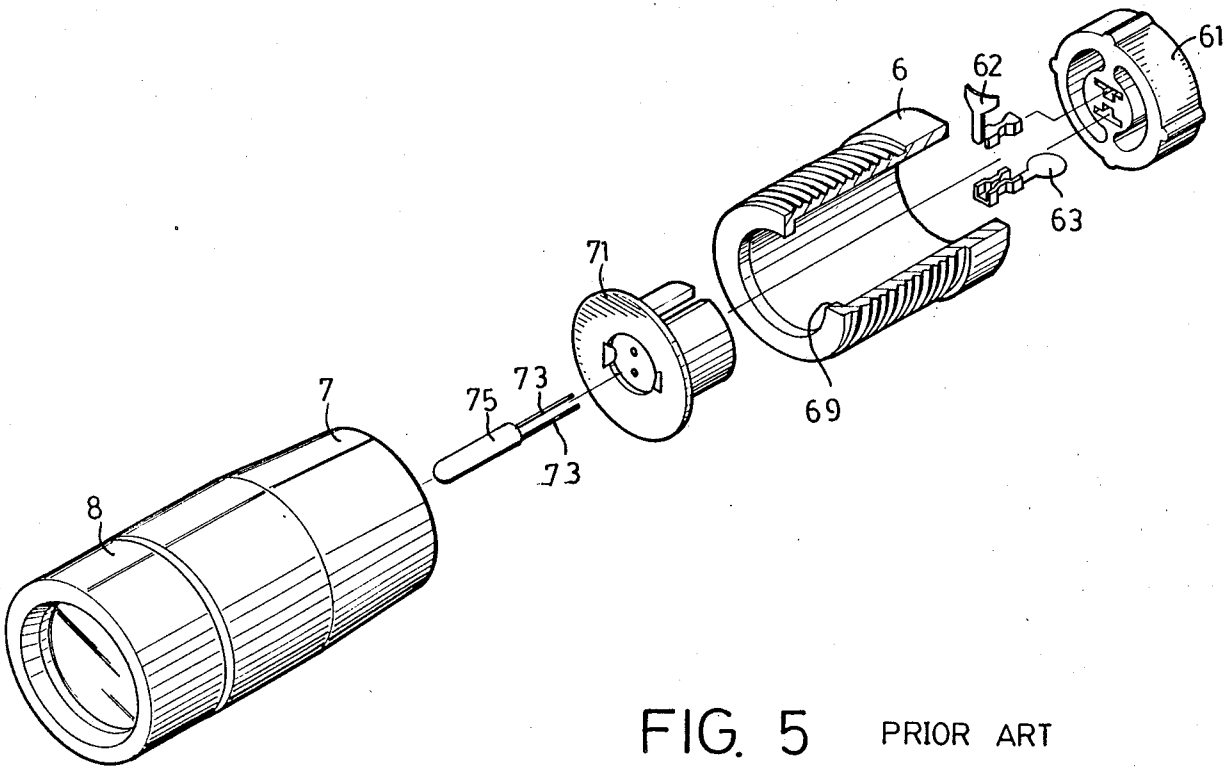
FIG. 5 PRIOR ART
FIG. 5 is a partially cutaway exploded perspective view of the miniature flashlight in accordance with the prior art.
Figure 7:
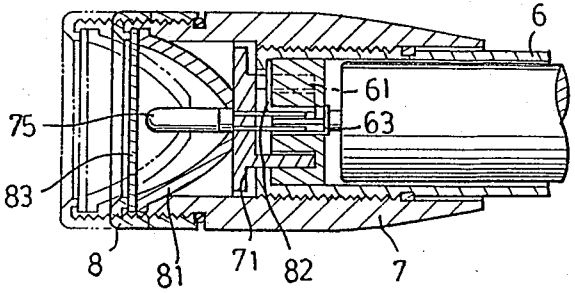
FIG. 7 PRIOR ART
FIG. 7 is a cutaway view similar to FIG. 6, illustrating the motion of the head relative to the tube.
Figure 6:
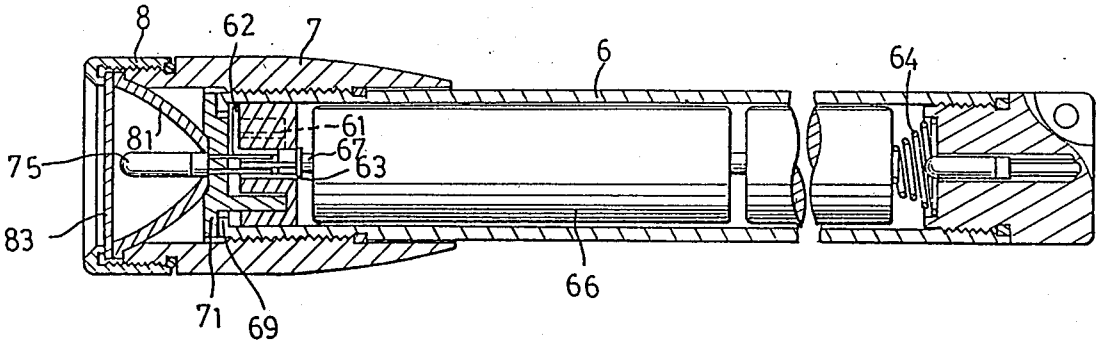
FIG. 6 PRIOR ART
FIG. 6 is a cross-sectional view of the miniature flashlight of FIG. 5.

Referring next to FIGS. 3 and 4, when the control ferrule 3 is properly rotated, a relative sliding movement occurs between the control ferrule 3 and the socket 4 by the threaded connection therebetween and by the guidance of the guide lugs 51. As shown in FIG. 3, the socket 4 moves slightly backward until the folded end 97 of the resilient blade 93 electrically contacts an anode of an adjacent battery 66 so as to a close the circuit of the invention and turn on the light bulb 75. Further rotating the control ferrule 3 causes the socket 4 to slide further backwards until the stop 49 touches the lugs 51 of the sleeve 5, as shown in FIG. 4. From FIG. 2 to FIG. 4, the light bulb 75 can also be slid rearward relative to the reflector 23 in order to change the dispersion of the light beam.

It is to be recognized that the rotation of the control ferrule 3 does not cause any relative axial movement between the control ferrule 3 and the tube 1. The control ferrule 3 is rotatably retained by the retaining ring 14. Therefore, it is impossible to remove the control ferrule inadvertently. Sealing rings 13, 15, 24 and 21 make a perfect airtight sealing for the miniature flashlight of the present invention.

While I have described a preferred embodiment of the present invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A miniature flashlight comprising a cylindrical tube enclosed at a rear end by a tail cap; a control ferrule rotatably connected to a front end of said cylindrical tube; a retaining ring being rotatably provided within two abutment grooves, said grooves being respectively formed on an outer surface of said front end of said cylindrical tube and on an inner surface of said control ferrule such that said control ferrule is rotatably retained on said cylindrical tube; a face cap with a lens and a reflector being provided with said face cap threadedly engaged at a front end of said control ferrule; at least one battery being disposed within said cylindrical tube; a spring member being located between said tail cap and an adjacent battery; a guide means being disposed within said front end of said cylindrical tube; a slidable socket threadedly connected within said control ferrule in order to be pushed by a rotation of said control ferrule to move along a longitudinal axis of said cylindrical tube; a first and a second resilient conductors being disposed in said slidable socket with one end of said first resilient conductor slidably connecting said guide means and one end of said second resilient conductor contractable with an anode of a foremost battery; a light bulb plugged into said slidable socket; and said slidable socket being slidable either forward or backward by the rotation of said control ferrule and being capable of bringing said end of said second resilient conductor into contact with said anode of said foremost battery.

* * * * *